US006222158B1

(12) United States Patent
Nakata et al.

(10) Patent No.: US 6,222,158 B1
(45) **Date of Patent: *Apr. 24, 2001**

(54) FIXING HEATER COMPRISING ELECTRICALLY CONDUCTIVE MEMBER EXTENDING IN THE LONGITUDINAL AXIS OF SUBSTRATE

(75) Inventors: Yasuhiro Nakata; Toshio Yoshimoto, both of Yokohama; Yasumasa Nashida, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/814,010

(22) Filed: Mar. 10, 1997

Related U.S. Application Data

(63) Continuation of application No. 08/168,505, filed on Dec. 22, 1993, now abandoned.

(30) Foreign Application Priority Data

Dec. 29, 1992 (JP) ..... 4-361598

(51) Int. Cl.[7] ..... G03G 15/00; G03G 15/20

(52) U.S. Cl. ..... 219/216; 219/494; 219/543

(58) Field of Search ..... 219/216, 494, 219/543; 399/328, 329, 335, 338

(56) References Cited

U.S. PATENT DOCUMENTS

| | | | | |
|---|---|---|---|---|
| 3,892,947 | | 7/1975 | Strengholt . | |
| 3,916,256 | | 10/1975 | Kotani . | |
| 5,083,168 | | 1/1992 | Kusaka et al. . | |
| 5,148,226 | | 9/1992 | Setoriyama et al. . | |
| 5,376,773 | * | 12/1994 | Masuda et al. | 219/216 |

FOREIGN PATENT DOCUMENTS

| | | | | |
|---|---|---|---|---|
| 3028534 | | 2/1982 | (DE) . | |
| 56-24180 | * | 3/1981 | (JP) . | |
| 58-5772 | | 1/1983 | (JP) . | |
| 2-143277 | * | 6/1990 | (JP) | 355/289 |

* cited by examiner

*Primary Examiner*—Samuel M. Heinrich
(74) *Attorney, Agent, or Firm*—Fitzpatrick, Cella, Harper & Scinto

(57) ABSTRACT

A fixing heater includes a ceramic substrate; a heat generating resistor provided on the ceramic substrate to extend in a longitudinal axis of the ceramic substrate; a temperature detecting element for detecting a temperature of the ceramic substrate; and an electrically conductive member provided on the ceramic substrate to extend in the longitudinal axis of the ceramic substrate.

3 Claims, 11 Drawing Sheets

FIXING HEATER COMPRISING ELECTRICALLY CONDUCTIVE MEMBER EXTENDING IN THE LONGITUDINAL AXIS OF SUBSTRATE

This application is a continuation of Application Ser. No. 08/186,505, filed Dec. 22, 1993, now abandoned.

FIELD OF THE INVENTION AND RELATED ART

In recent years, fixing apparatuses comprising a heater in which a heat generating resistor is formed on a thermally conductive ceramic substrate have been proposed, for example, in U.S. Pat. No. 5,148,226; and U.S. Ser. No. 712,532, or the like.

Such a heater has a small thermal capacity; therefore, it can quickly change the apparatus temperature. Also, there is no rush current. Having these characteristics gives an advantage as a heat source for the fixing device in an image recording apparatus, for example, and makes such a heater superior to a halogen heater which constitutes the mainstream of the heat generating source for the thermal fixing devices.

FIG. 1 shows an example of such a heater.

FIG. 1(*a*) is a partially cutaway plan view of the front surface of the above-mentioned heater 3, and FIG. 1(*b*) is a plan view of the rear surface thereof. A heat generating thick film resistor 5 generates heat as a voltage is applied between power supply electrodes 8 and 9 connected to the opposite ends of the heat generating resistor 5.

As for the temperature control of the heater 3, the power supplied to the heat generating thick film resistor 5 is controlled to keep constant the temperature of the heater 3 detected by a thermistor 6.

FIG. 2 shows a thermal fixing apparatus of the through-film heating type in which the heat generating thick film resistor 5 formed on a ceramic substrate 4 is used as the heat source. This type of thermal fixing apparatus 1 has advantages such that it quickly starts up because of the fast temperature rise of the heater 3; it can save electricity; and the like. In other words, it is very effective.

However, the small thermal capacity of the heater 3 makes it difficult to control. Generally speaking, the thermal fixing device in an image recording apparatus is controlled to keep a constant temperature; therefore, it is not preferable for the temperature to change suddenly during the image fixing operation.

Thus, when the heat generating thick film resistor 5 is used as the heat source for the thermal fixing apparatus, such a heat generating thick film resistor 5 that has a slightly higher power rating than the actually needed power rating is employed and the power applied to the heat generating thick film resistor 5 is controlled in phase or in wave number to keep constant the temperature.

Therefore, when a temperature sensor 6 of the heater 3, or the circuit for controlling the driving means of the heat generating thick film resistor 5 malfunctions and the power is continuously supplied to the heat generating thick film resistor 5, the temperature of the heat generating thick film resistor 5 rapidly increases.

When such an anomaly is left unattended, the thermal fixing device is liable to start smoking or flaming, eventually. Thus, in anticipation of such a situation, the thermal fixing apparatus is provided with a thermal protector 13 (FIG. 4(*b*)) such as a thermal fuse.

Further, in order not to induce the above-mentioned abnormal condition, a current transformer, photocoupler, or the like may be provided to prepare for the malfunctioning of a triac or the like which controls the power supplied to the heat generating thick film resistor 5, wherein when it is detected that a current is flowing through the heat generating thick film resistor 5 while no driving signal is sent out from the temperature control circuit, a control system comprising a relay or the like, being independent from the triac, is used to interrupt the power supply.

However, the thermal protector 13 such as the thermal fuse has generally a larger thermal capacity than the heat generating resistor 5 or ceramic substrate 4 which makes up the heater, and responds slower. Therefore, before the thermal protector 13 responds, the heater 3 (ceramic substrate on which the heat generating thick film resistor is formed) breaks because of thermal stress. When such a condition occurs, electrical discharge begins between adjacent broken pieces of the heat generating thick film resistor 5, corresponding to the fracture lines of the heater. Since the ambient temperature is high, the combustibles in the surrounding areas are easily ignited, causing smoking or flaming.

SUMMARY OF THE INVENTION

Accordingly, a primary object of the present invention is to provide a fixing heater in which the heat generation of the resistor can be reliably stopped when the ceramic substrate fractures.

Another object of the present invention is to provide a fixing heater in which smoking or flaming can be prevented even when the ceramic substrate fractures.

According to an aspect of the present invention, the fixing heater comprises: a ceramic substrate; a heat generating resistive member which is formed on the ceramic substrate in such a manner as to extend in the longitudinal axis of the ceramic substrate; a temperature detecting member for detecting the temperature of the ceramic substrate; and an electrically conductive member formed on the ceramic substrate in such a manner as to extend in the longitudinal axis of the ceramic substrate.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 4:
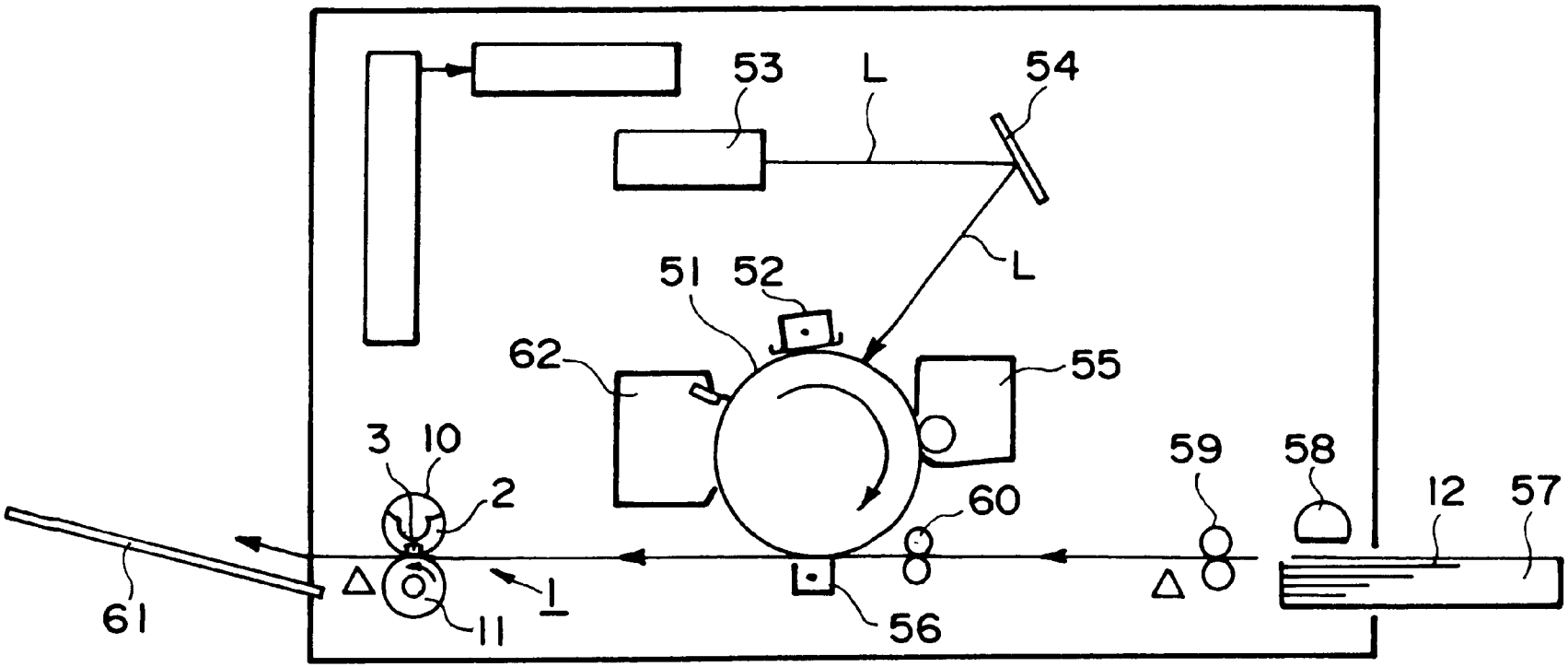
FIG. 4 is a sectional view of an image forming apparatus.

FIG. 4 is a simplified sectional view of an image forming apparatus comprising the fixing heater according to the embodiment of the present invention. This image recording apparatus is a laser printer based on the electrophotographic process. A reference numeral 51 designates an electrophotographic sensitive member of a drum type, which is rotatively driven in the clockwise direction indicated by an arrow at a predetermined peripheral speed (process speed). This rotary photosensitive member 51 is charged by a charger 52 to a predetermined polarity and potential and is next exposed to a scanning laser beam L, modulated in response to time series electrical digital signals carrying the imaging data for a target image and outputted from a laser scanner 53, whereby an electrostatic latent image reflecting the imaging data for the target image is formed on the rotary photosensitive member 51. A reference numeral 54 designates a mirror for polarizing the laser beam.

The electrostatic latent image is visualized as a toner image by a developing device 55. Then, this toner image is transferred by a transfer charger 56 onto a recording material (transfer material) 12, which is fed out of a sheet feeder cassette 57 by a feed roller 58; is passed through a conveyer roller pair 59, a registration roller pair 60, and the like; and is delivered into a transfer station between the rotary photosensitive member 51 and transfer charger 56.

The recording material 12 on which the toner image was transferred is carried to the thermal fixing apparatus, where the toner image is fixed in the above-described manner. Finally, the recording material 12 with the fixed image is discharged into a discharge tray 61. After the image is transferred, the rotary photosensitive member 51 is cleaned by a cleaning device 62 to be repeatedly used for the image formation.

Figure 1A:
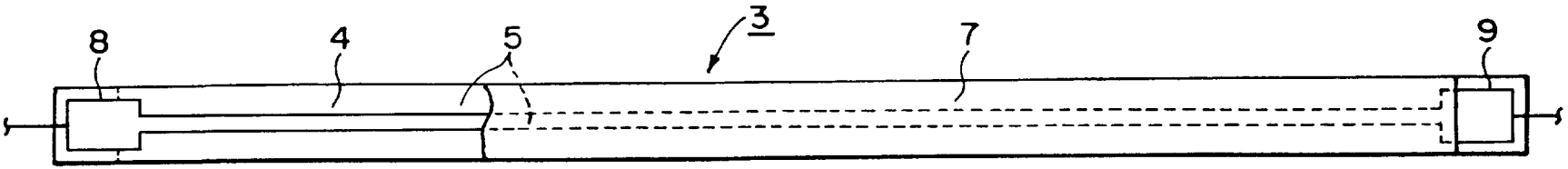
FIG. 1(a) PRIOR ART
FIG. 1(*a*) is a front view of an example of a heater, and FIG. 1(*b*) is a rear view thereof.
Figure 1B:
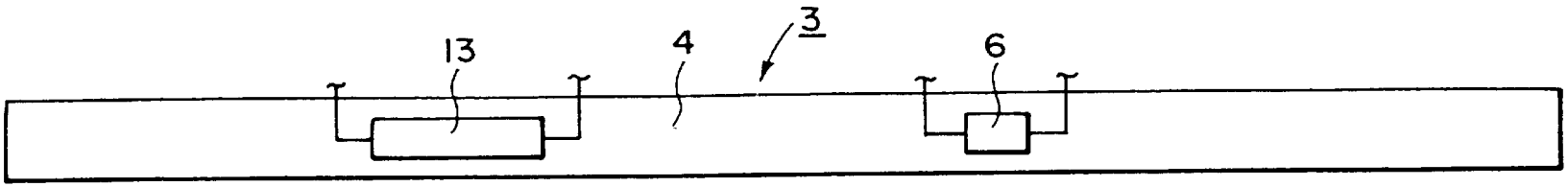
FIG. 1(b) PRIOR ART
Figure 2:
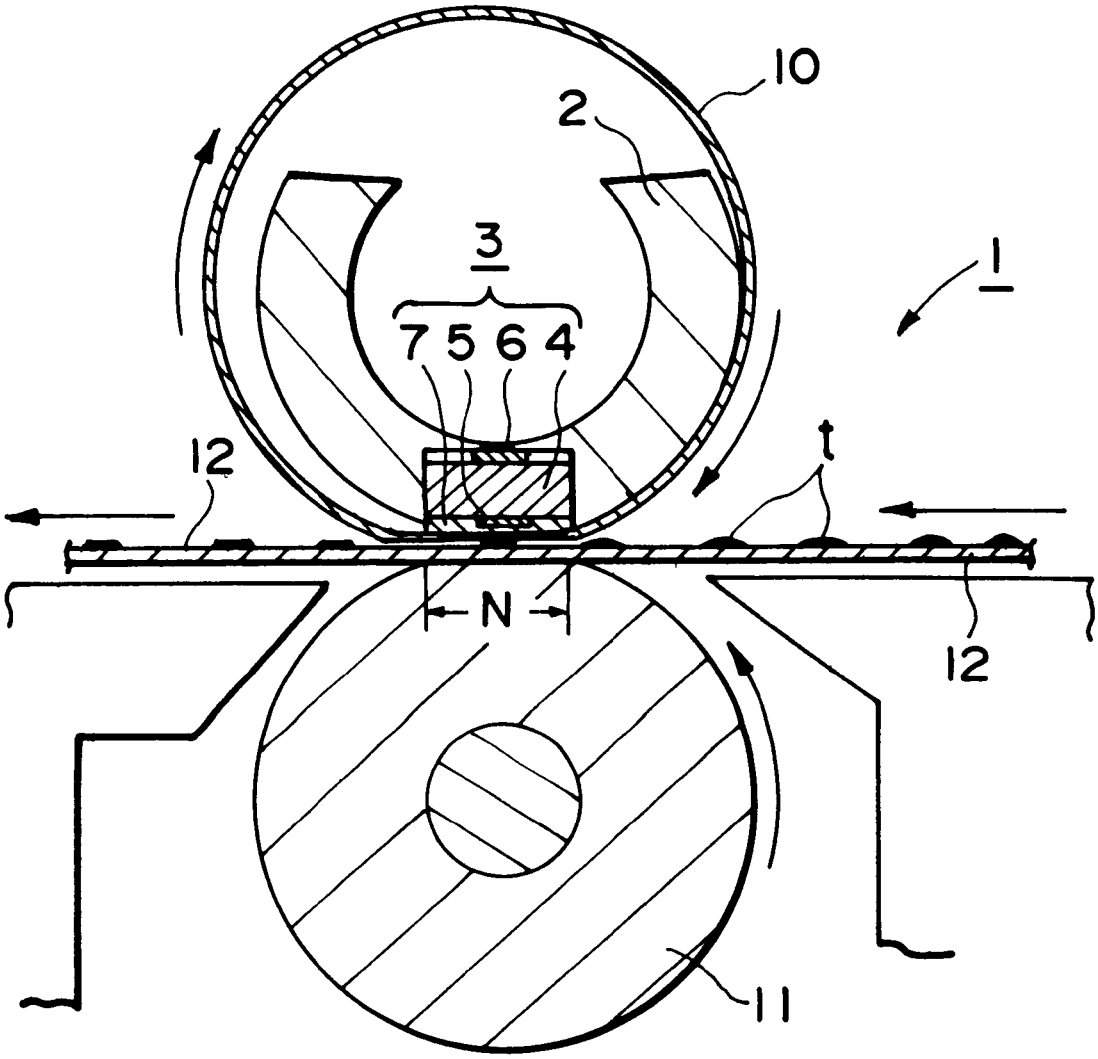
FIG. 2 is a sectional view of a fixing apparatus.
Figure 3:
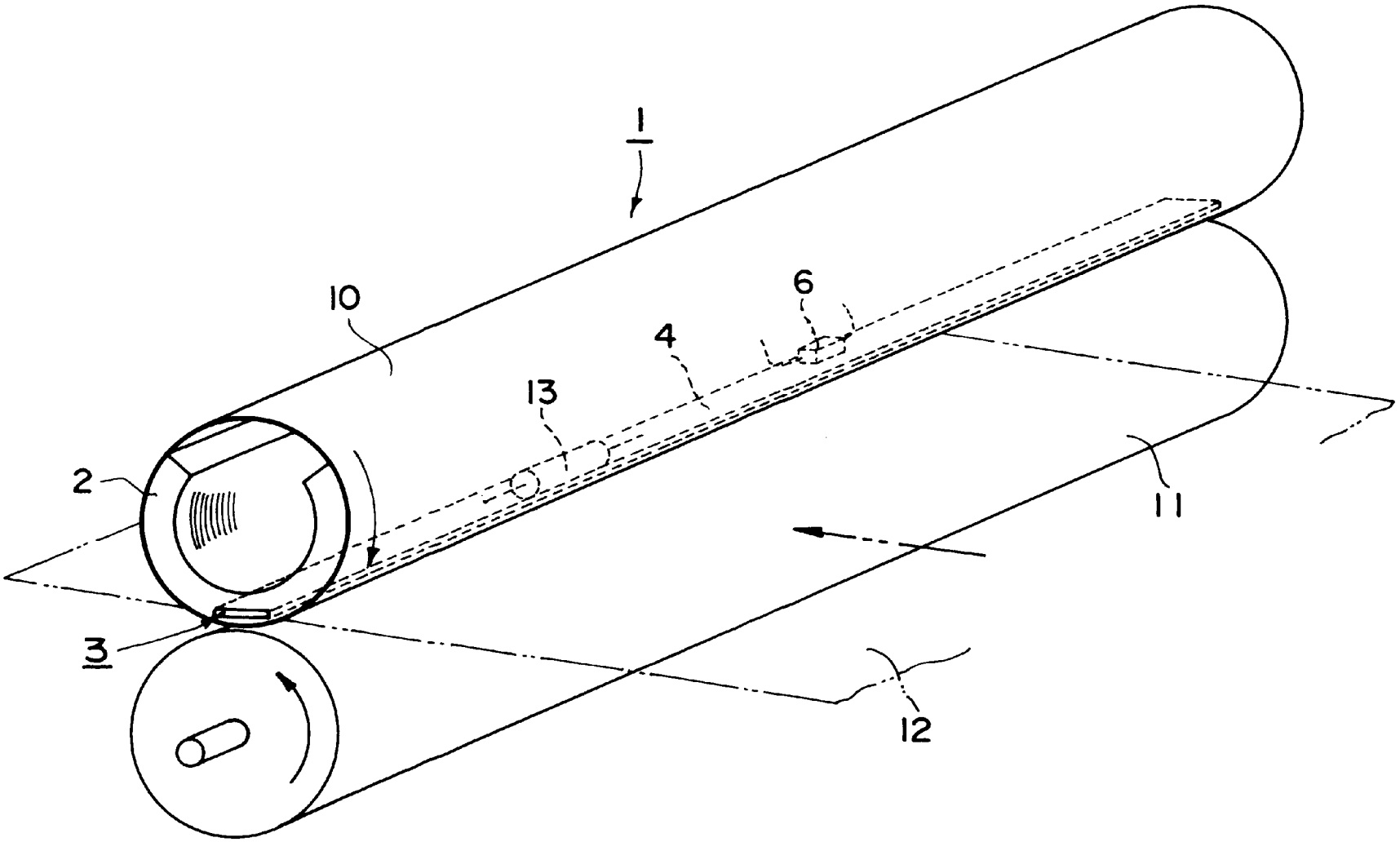
FIG. 3 is an oblique view of the apparatus shown in FIG. 2.

FIGS. 2 and 3 are a sectional view and an oblique view, respectively, of the fixing apparatus.

A reference numeral 1 designates the entire structure of the thermal fixing apparatus. A reference numeral 2 designates an internal film guide member in the form of a trough having a semicircular cross section. On this guide member 2, a groove is cut in a manner so as to extend in the longitudinal axis of the guide member 2, approximately in the middle of the outward facing surface, and the heater 3 is embedded in the groove of the guide member 2, being thereby supported by the guide member 2. Around the internal film guide member 2 with the embedded heater 3, a cylindrical heat resistant film 10 is loosely fitted, wherein the film 10 is sandwiched between the heater 3 and the pressure roller 11 comprising an elastic rubber layer made of a material with superior separativeness, such as silicon rubber.

As the pressure roller 11 is rotatively driven, the cylindrical fixing film 10 rotates around the internal film guide member 2, with the cylindrical fixing film 10 being firmly in contact with and sliding on the downward facing surface of the heater.

While the film is rotatively driven in the above-described manner, a recording material 12 as the material to be heated is introduced into the nip formed between the film 10 and pressure roller 11. While the recording material 12 is passed through the fixing nip N, the heat from the heater 3 is transmitted through the film 10 to the recording material 12, whereby an unfixed toner image t on the recording material 12 is thermally fixed.

The fixing film 10 is a monolayer or multilayer film, excellent in heat resistance, separativeness, and durability, and generally speaking, is preferred to be less than 100 $\mu$m in the overall thickness, more preferably, no more than 40 $\mu$m. As for the material for the fixing film 8, the following may be used: a monolayer film of PTFE, PFA, FEP, or the like; or a multilayer film comprising a base film of polyimide, polyamideimide, PEEK, PES, PPS, or the like and a layer of PTFE, PFA, FEP, or the like, coated on the outward facing surface of the base film.

The heater 3 comprises: a ceramic plate 4 as a heater substrate, a heat generating thick film resistor 5, a temperature detecting device 6 such as a thermistor, and a surface protector layer 7 such as a thin layer of heat resistant glass or fluorinated resin. The ceramic plate 4 is made of highly heat resistant, dielectric material such as alumina, measuring 1 mm thick, 6 mm wide, and 240 mm long, and extending in the direction perpendicular to the direction in which the recording material 12 is advanced, and has a low thermal capacity. The heat generating thick film resistor 5 is made of heat generating resistive material such as Ag/Pd, $RuO_2$, $Ta_2N$, or the like and is formed by printing on the ceramic plate 4 in the form of a 1 mm wide pattern extending in the longitudinal axis of the ceramic plate 4, on the outward facing side of the ceramic plate 4 (the side which comes in contact with the film). The temperature detecting device 6 is provided on the inward facing surface (surface opposite to the side where the heat generating resistor is provided) of the ceramic plate 4, and the surface protector layer 7 covers the heat generating resistor 5 and the surface on which the heat generating resistor 5 is on. This heater 3 is embedded (supported thereby) in the groove of the internal film guide member 2 in such a manner that the surface of the ceramic plate 4, on which the heat generating thick film resistor is located, faces outward.

Figure 5:
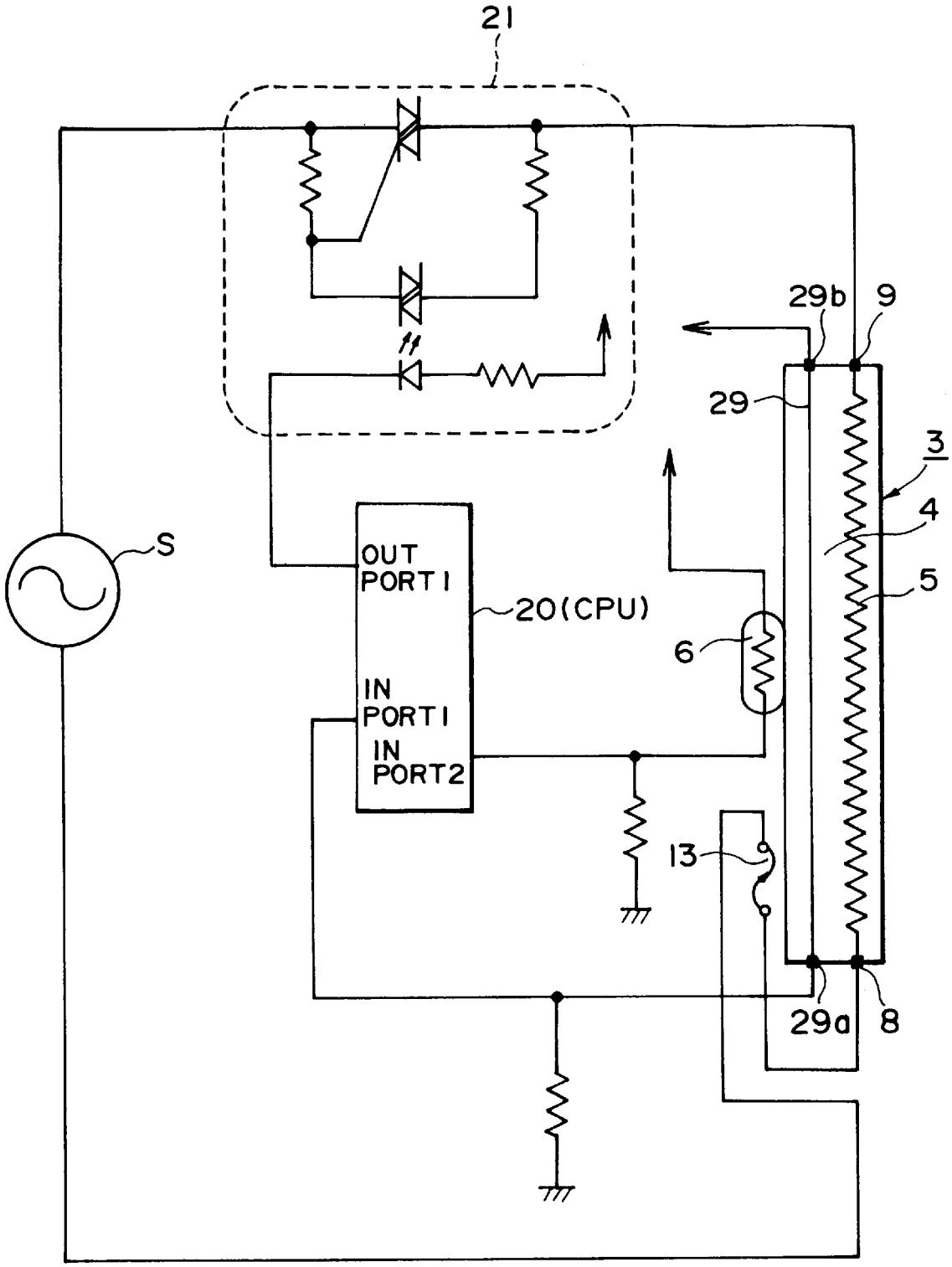
FIG. 5 is a constant temperature control circuit diagram for the embodiment of the apparatus according to the present invention.
Figure 6:
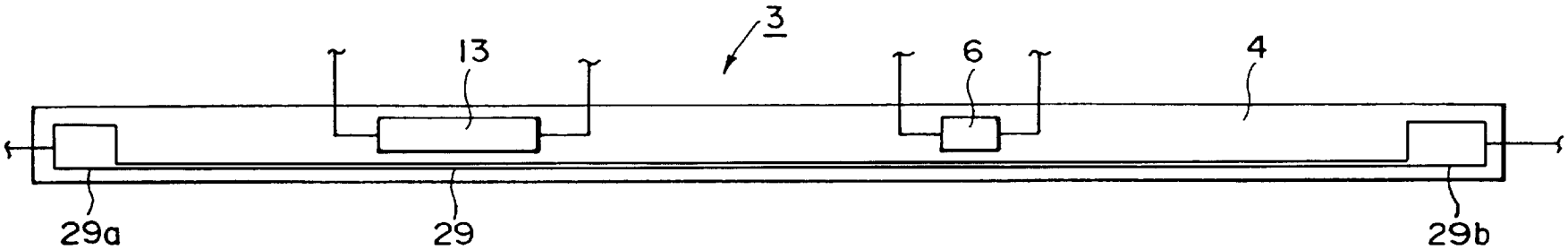
FIG. 6 is a plan view of the rear surface of the heater.

FIG. 5 is a circuit diagram of a control circuit provided in the fixing apparatus according to the present invention, for keeping the temperature of the heat generating resistor constant at a predetermined temperature. FIG. 6 is a plan view of the inward facing surface (the surface opposite to the one where the heat generating thick film resistor 5 is located).

A reference numeral 20 designates a single chip microcontroller as a temperature control circuit (CPU), and a reference numeral 21 designates a heater control circuit. With reference to the CPU 20, an INPORT 1 is a port for digital input.

A reference numeral 29 designates an electrically conductive film formed on the inward facing surface of the ceramic plate 4 of the heater 3, in such a manner as to extend in the longitudinal axis of the ceramic plate 4 substantially parallel to the heat generating thick film resistor 5. This conductive thin film is electrically independent from the heat generating thick film resistor 5. Reference numerals 29*a* and 29*b* designate electrodes provided at the opposite ends of the conductive film.

During a normal image forming operation, the CPU 20 detects the change in the resistance value of the thermistor 6 through the INPORT 2, which is an A/D conversion port, detecting thereby the temperature of the ceramic plate 4. Then, the CPU 20 controls the output of an OUTPORT 1 to control the heater control circuit 21, driving thereby the heat generating thick film resistor 5 in such a manner that the detected temperature remains constant at the predetermined one.

The CPU 20 carries out the above-described operation when a signal "High" is inputted through the INPORT 2, and controls the heater control circuit 21 so as not to drive the heat generating thick film resistor 5 when a signal is "Low."

Now, suppose that the thermistor 6 malfunctions and the CPU 20 erroneously determines that the temperature of the ceramic plate 4 is lower than the actual temperature. In this case, the CPU 20 controls the heater control circuit 21 in such a manner that the heat generating thick film resistor 5 remains in the state of being driven. As a result, the ceramic plate 4 is subjected to the sudden temperature increase, and fractures because of the heat stress. As the ceramic plate 4 fractures, the conductive film 29 tears, causing the signal level at the INPORT 2 of the CPU 20 to be "Low." Therefore, the CPU 20 controls the heater control circuit 21 in such a manner that the power supply to the heat generating thick film resistor 5 is stopped.

Thus, according to this embodiment, even when the thermistor 6 malfunctions and the ceramic plate 4 fractures, the power supply to the heat generating thick film resistor 5 is interrupted the moment the ceramic plate 4 fractures, thereby preventing the electrical discharge; therefore, smoking or flaming never occurs.

Figure 7:
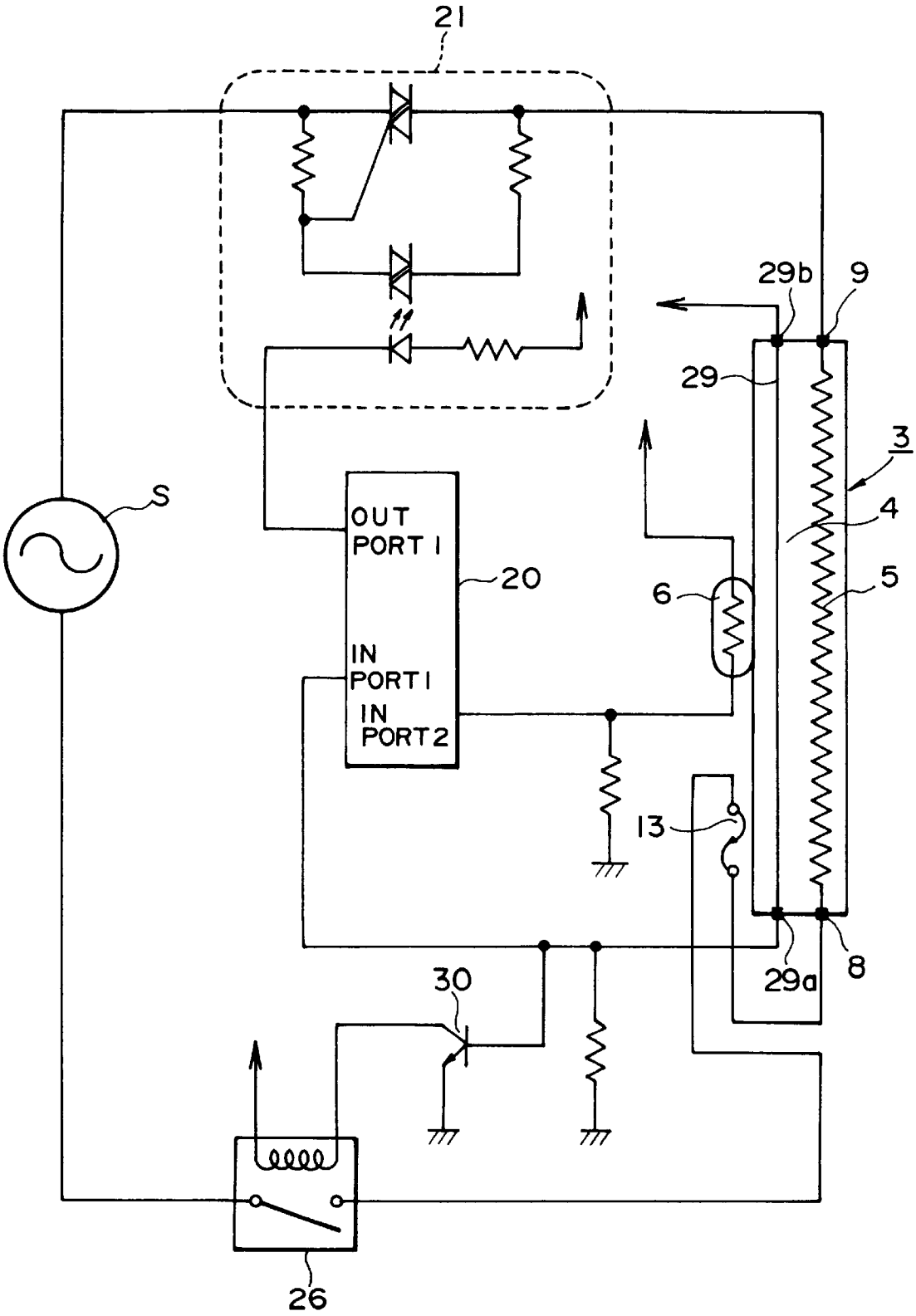
FIG. 7 is a constant temperature control circuit diagram for an alternative embodiment of the apparatus according to the present invention.

FIG. 7 shows an alternative embodiment of the present invention. In this embodiment, a relay 26 is employed as the means (mechanism for cutting off the power supply) that stops the driving of the heat generating thick film resistor 5, without involving the CPU.

As long as the conductive film 29 is intact, the relay 26 does not cut off the power source. When the thermistor 6 malfunctions, not only does the CPU 20 control the heater control circuit 21 to stop the power supply to the heat generating thick film resistor 5, but also, the relay 26 cuts off the power supply, through a transistor 30 as a control circuit of the mechanism for cutting off the power source.

In the third embodiment described previously, no means is available for handling a situation in which the CPU 20 malfunctions. But, in this embodiment, the power supply can be cut off without involving the CPU 20.

Therefore, even when such an abnormal situation occurs that the CPU 20 malfunctions and keeps on driving the heat generating thick film resistor 5, the relay 26 cuts off the power supply to the heat generating thick film resistor 5 the moment the ceramic plate 4 fractures; therefore, the smoking or flaming caused by the electrical discharge can be prevented.

Next, another preferable embodiment will be described.

Figure 8:
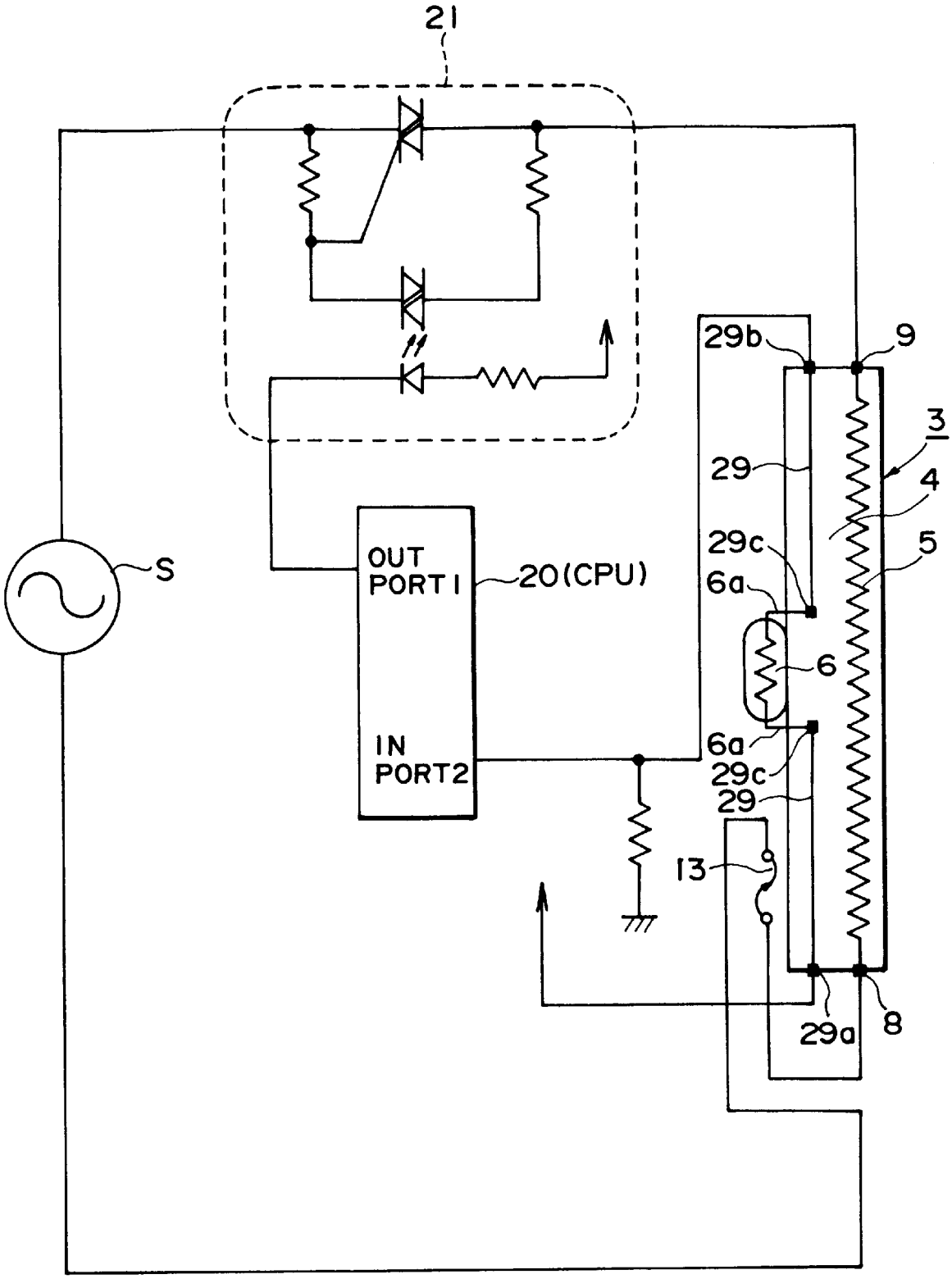
FIG. 8 is a constant temperature control circuit diagram for another alternative embodiment of the present invention.
Figure 9:
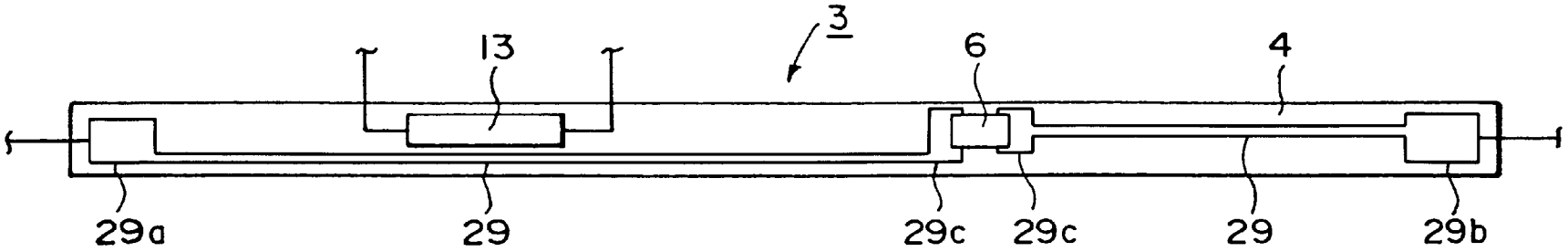
FIG. 9 is a plan view of the rear surface of the heater.
Figure 10:
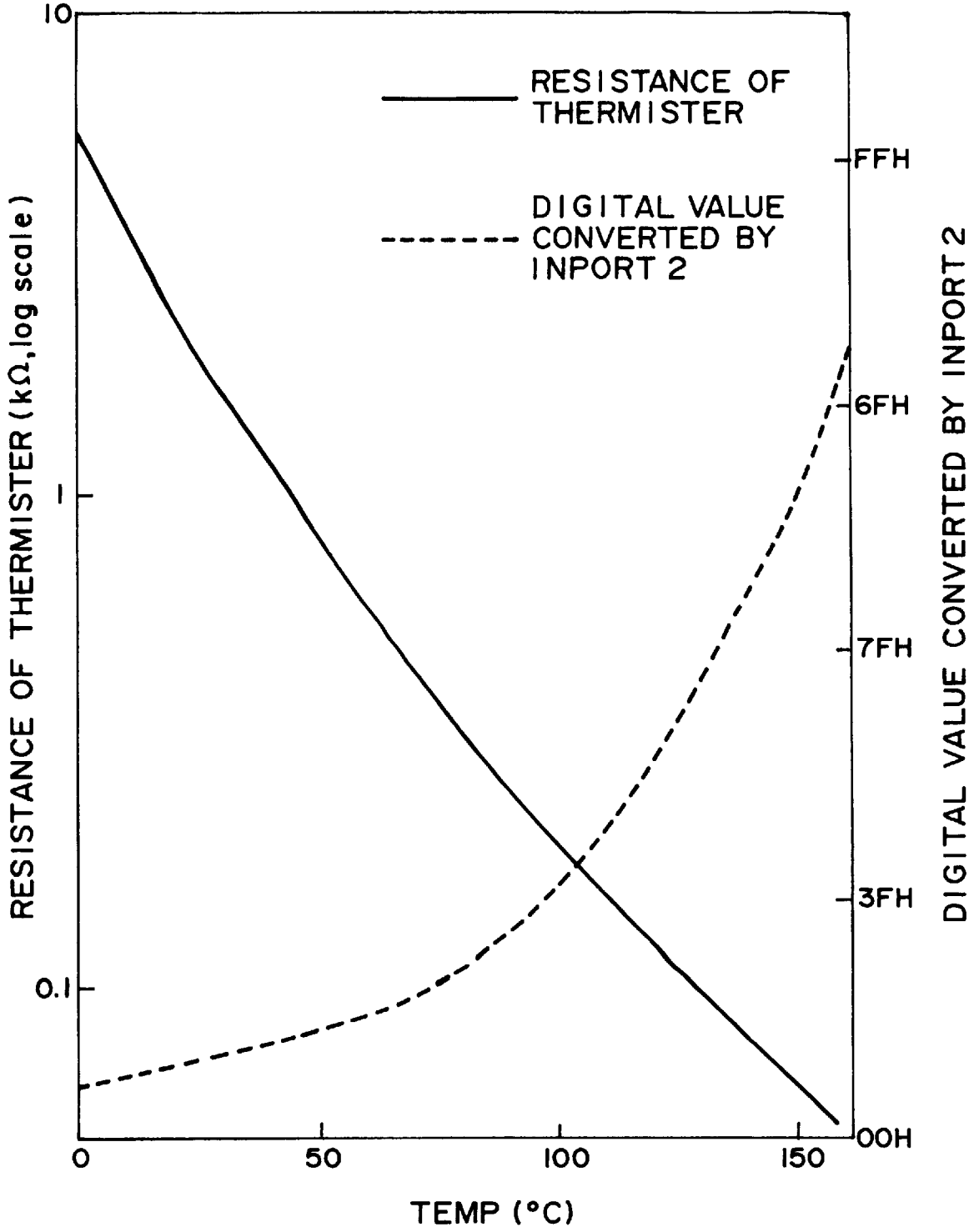
FIG. 10 is a graph showing the relations between the thermistor temperature, the resistance value, and the digitized output value of the A/D converter.

FIG. 8 is a circuit diagram of a control circuit provided in the fixing apparatus according to the present invention, for keeping the temperature of the heat generating thick film resistor 5 constant at a predetermined temperature. FIG. 9 is a plan view of the inward facing surface (the surface opposite to the one where the heat generating thick film resistor 5 is on) of the heater 3. FIG. 10 is a graph depicting the relation between the temperature of the thermistor 6 and the resistance value.

A reference numeral 29 designates an electrically conductive film formed on the inward facing surface of the ceramic plate 4 of the heater 3, in such a manner as to extend in the longitudinal axis of the ceramic plate 4 substantially parallel to the heat generating thick film resistor 5. This conductive film 29 is electrically independent from the heat generating thick film resistor 5 and a thermistor 6 is connected in series in such a manner as to divide the conductive film 29 approximately at the midway portion. Reference numerals 29*c* and 29*c* designate the electrical contacts between the conductive film 29 and electrodes 6*a* and 6*a* of the thermistor 6.

With reference to the CPU 20, an OUTPORT 1 is a port for a digitized output and an INPORT 2 is an A/D conversion port. As the temperature changes, the resistance value of the thermistor 6 changes, which changes the input voltage, giving the A/D converted values as shown in FIG. 10.

During a normal image forming operation, the CPU 20 receives the resistance value change of the thermistor 6 through the INPORT 2 which is an A/D conversion port, detecting thereby the temperature of the ceramic plate 4. Then, the CPU 20 controls the output of an OUTPORT 1 to control the heater control circuit 21, driving thereby the heat generating thick film resistor 5 in such a manner that the detected temperature remains constant at the predetermined temperature.

Now, suppose that the thermistor 6 malfunctions and the CPU 20 erroneously determines that the temperature of the ceramic plate 4 is lower than the actual one. In this case, the CPU 20 controls the heater control circuit 21 in such a manner that the heat generating thick film resistor 5 remains in the state of being driven. As a result, the ceramic plate 4 is subjected to the sudden temperature increase, and breaks because of the heat stress.

As the ceramic plate 4 breaks, the conductive film 29 also breaks, causing the voltage at the INPORT 2 to drop to 0 V. Therefore, the A/D converted value at the INPORT 2 instantly changes to 00H. Detecting that the the A/D converted value instantly changes to 00H, the CPU 20 controls the heater control circuit 21 in such a manner that the power supply to the heat generating thick film resistor 5 is stopped.

Thus, according to this embodiment, even when the thermistor 6 malfunctions and the ceramic plate 4 fractures, the power supply to the heat generating thick film resistor 5 is interrupted the moment the ceramic plate fractures; therefore, the electrical discharge is prevented and smoking or flaming never occurs.

Figure 11:
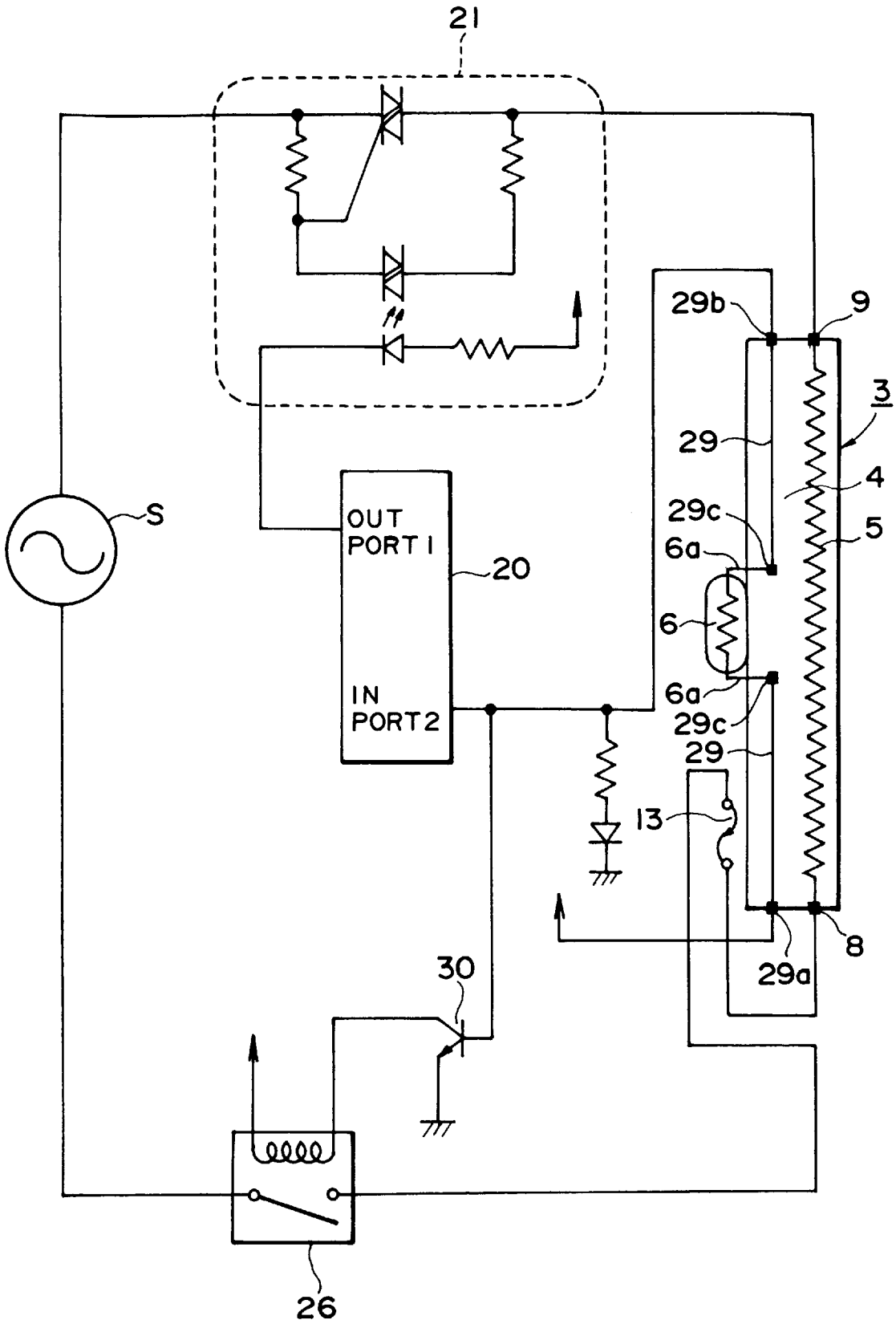
FIG. 11 is a constant temperature control circuit diagram for another alternative embodiment of the present invention.

FIG. 11 shows another alternative embodiment of the present invention. In this embodiment, a relay 26 is employed as the means (mechanism for cutting off the power source) that stops the driving of the heat generating thick film resistor 5, without involving the CPU 20.

As long as the conductive film 29 remains intact, the relay 26 does not cut off the power supply. This is because the base of the transistor 30 which drives the relay 26 is supplied, through the thermistor 6, with a current sufficient to maintain the ON state of the relay 26. Therefore, during a normal image recording operation, this embodiment operates in the same manner as the fifth embodiment.

Now, description will be given as to the operation carried out when the thermistor 6 malfunctions and the ceramic plate 4 fractures. In this case, the current supplied to the base of the transistor 30, which drives the relay 26, is cut off; and the transistor 30 is turned off. Therefore, the relay 26 becomes opened, cutting off the power supply to the heat generating thick film resistor 5. And, at the same time, the heater control circuit 21 is controlled by the CPU 20 in such a manner that the power supply to the heat generating thick film resistor 5 is interrupted.

In the case of the fifth embodiment, no means is available for handling a situation such as when the CPU 20 malfunctions or temperature control circuit 21 malfunctions because of short-circuiting. But, in this embodiment, the power supply can be cut off without involving the CPU 20. Therefore, even during an abnormal operation in which the CPU malfunctions and keeps on driving the heat generating thick film resistor 5, not only does the ceramic plate 4 fracture, but also, the relay 26 cuts off the power supply to the heat generating thick film resistor 5, preventing the smoking or flaming caused by the electrical discharge.

In the foregoing, the heat generating resistor 5 formed on the ceramic plate 4 was described as the heat generating thick film resistor formed by using the thick film printing technology. However, it is needless to say that different heat generating resistors formed by using different technologies are also acceptable.

While the invention has been described with reference to the structures disclosed therein, it is not confined to the details set forth and this application is intended to cover such modifications or changes as may come within the purposes of the improvements or the scope of the following claims.

What is claimed is:

1. A fixing apparatus comprising:

a fixing heater including an elongated ceramic substrate, a heat generating resistor extended along substantially an entire length of said ceramic substrate, a thermistor for detecting a temperature of said ceramic substrate, and an electrically conductive film for supplying an output of said thermistor, wherein said electrically, conductive film is formed on said ceramic substrate and extends on said substrate substantially over the entire length thereof;

a semiconductor switching element connected between a power supply and said heat generating resistor;

control means for controlling said semiconductor switching element so that the output of said thermistor is maintained at a predetermined value, said control means opening said semiconductor switching element when no current is flowing through said electrically conductive film; and a relay connected between the power supply and said heat generating resistor and operable independently of said control means, said relay interrupting an electric power supply to said heat generating resistor when no current is flowing through said electrically conductive film.

2. A fixing apparatus according to claim 1, wherein said heat generating resistor is provided on one side of said ceramic substrate, and said thermistor and electrically conductive film are provided on an opposite side.

3. A fixing apparatus according to claim 1, wherein said heat generating resistor and electrically conductive film are parallel to each other.

* * * * *

UNITED STATES PATENT AND TRADEMARK OFFICE

CERTIFICATE OF CORRECTION

PATENT NO. : 6,222,158 B1
DATED : April 24, 2001
INVENTOR(S) : Yasuhiro Nakata et al.

It is certified that error appears in the above-identified patent and that said Letters Patent is hereby corrected as shown below:

Drawings,
Figure 10, "THERMISTER" (both occurrences) should read -- THERMISTOR --.

Column 1,
Line 7, "08/186,505," should read -- 08/168,505, --.

Column 6,
Line 32, "the" (2nd occurrence) should be deleted.

Signed and Sealed this

Twenty-second Day of July, 2003

JAMES E. ROGAN
*Director of the United States Patent and Trademark Office*